US006021729A

United States Patent [19]

DeRuscio

[11] Patent Number: 6,021,729

[45] Date of Patent: Feb. 8, 2000

[54] PERSONAL WATERCRAFT FENDER AND METHOD

[75] Inventor: James C. DeRuscio, Fonda, N.Y.

[73] Assignee: Taylor Made Products, Gloversville, N.Y.

[21] Appl. No.: 09/032,063

[22] Filed: Feb. 27, 1998

[51] Int. Cl.[7] ..... B63B 59/02

[52] U.S. Cl. ..... 114/219; 114/270

[58] Field of Search ..... 114/219, 220, 114/270

[56] References Cited

U.S. PATENT DOCUMENTS

| | | | |
|---|---|---|---|
| 3,782,767 | 1/1974 | Moore | 114/219 |
| 4,584,958 | 4/1986 | Green | 114/219 |
| 5,207,171 | 5/1993 | Westwood, III | 114/219 |
| 5,299,521 | 4/1994 | Loucks | 114/219 |
| 5,671,692 | 9/1997 | Kimball | 114/219 |
| 5,701,837 | 12/1997 | Harvey | 114/219 |

FOREIGN PATENT DOCUMENTS

WO 93/22191 11/1993 WIPO .

*Primary Examiner*—Jesus D. Sotelo
*Attorney, Agent, or Firm*—Nixon & Vanderhye P.C.

[57] ABSTRACT

A fender for a personal watercraft includes a hook portion shaped to hook under the bond flange of the personal watercraft for quick and easy attachment. The fender includes at least one flex region enabling the fender to conform to either of the front hull and the rear section of the personal watercraft. An attachment member such as a suction cup and/or a securing line is disposed adjacent an end of the fender opposite from the hook portion for attachment to the personal watercraft. In the method of manufacturing the personal watercraft fender, a hook portion, one or more flex regions, and a channel for receiving the attachment member are formed via rotationally molded PVC, and the attachment member is secured in the channel in a second step. The fender may also be provided with a gas chamber filled with a pressurized gas such as air to provide added cushioning and longer life.

21 Claims, 2 Drawing Sheets

PERSONAL WATERCRAFT FENDER AND METHOD

BACKGROUND OF THE INVENTION

The present invention relates to fenders for boats and the like and, more particularly, to a flexible fender for a personal watercraft that is readily attachable to a front section of the personal watercraft accommodating the front hull thereof and also to the rear section of the personal watercraft.

Bumpers for boats and the like have been described in the prior art. For example, U.S. Pat. No. 4,584,958 to Green discloses a boat bumper that is constructed by combining a number of bumper units in a bumper chain. Each bumper unit includes a curved portion that is received in a socket portion of an adjacent bumper unit. U.S. Pat. No. 3,782,767 to Moore discloses a resilient shock absorbing bumper including resilient tubular members containing a gaseous material. Typically, the prior art bumpers are not particularly suited for personal watercrafts and the like.

SUMMARY OF THE INVENTION

Therefore it is an object of the invention to provide a watercraft fender that is readily attachable to a bond flange/rub rail of a personal watercraft. The fender is constructed so as to be conformable to a front hull or a rear section of the personal watercraft.

This and other objects of the invention are achieved by providing a fender for a personal watercraft having a bond flange, a front hull and a rear section. The fender includes a hook portion shaped to hook under the bond flange of the personal watercraft, at least one flex region spaced from the hook portion, the fender being conformable to either of the front hull or the rear section of the personal watercraft in accordance with the at least one flex region, and an attachment member such as a suction cup and/or a tie line disposed adjacent an end of the fender opposite from the hook portion.

The fender may be substantially J-shaped having a curved bottom section, an intermediate section, and a top section. In this context, the hook portion forms the curved bottom section, the at least one flex region is disposed in the intermediate section, and the attachment member is disposed adjacent the top section.

The fender may be provided with a gas chamber filled with pressurized gas such as air, and an inflation valve may also be provided operatively communicating with the gas chamber.

In a preferred arrangement, the fender is conformable between an open position engageable with the front hull of the personal watercraft and a closed position engageable with the rear section of the personal watercraft.

In accordance with another aspect of the invention, there is provided a method of manufacturing a fender for a personal watercraft. The method includes the steps of molding a hook portion shaped to hook under the bond flange of the personal watercraft and at least one flex region spaced from the hook portion such that the fender is conformable to either of the front hull or the rear section of the personal watercraft, and securing an attachment member adjacent an end of the fender opposite from the hook portion. In this context, the molding step is preferably practiced by rotational molding with a suitable material such as PVC.

In accordance with yet another aspect of the invention, there is provided a fender for a personal watercraft including a hook portion shaped to hook under the bond flange of the personal watercraft, at least one flex region spaced from the hook portion, the fender being conformable to either of the front hull or the rear section of the personal watercraft in accordance with the at least one flex region, and a gas chamber filled with pressurized gas.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
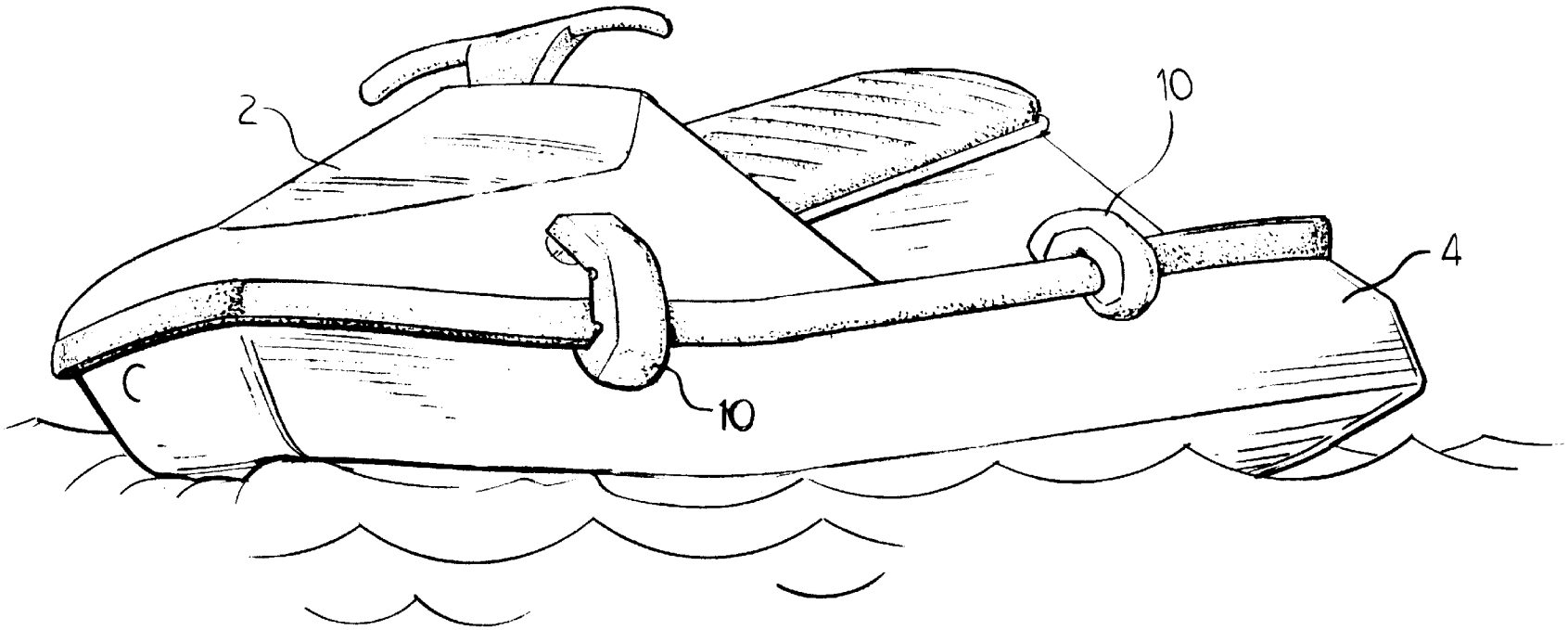
FIG. 1 is a perspective view of a personal watercraft illustrating the fender according to the present invention in use.

FIG. 1 illustrates the fender according to the present invention that may be attached to a personal watercraft. As shown, the fender 10 is conformable by virtue of its structure between an open position engageable with the front hull 2 of the personal watercraft and a closed position engageable with the rear section 4 of the personal watercraft.

Figure 2:
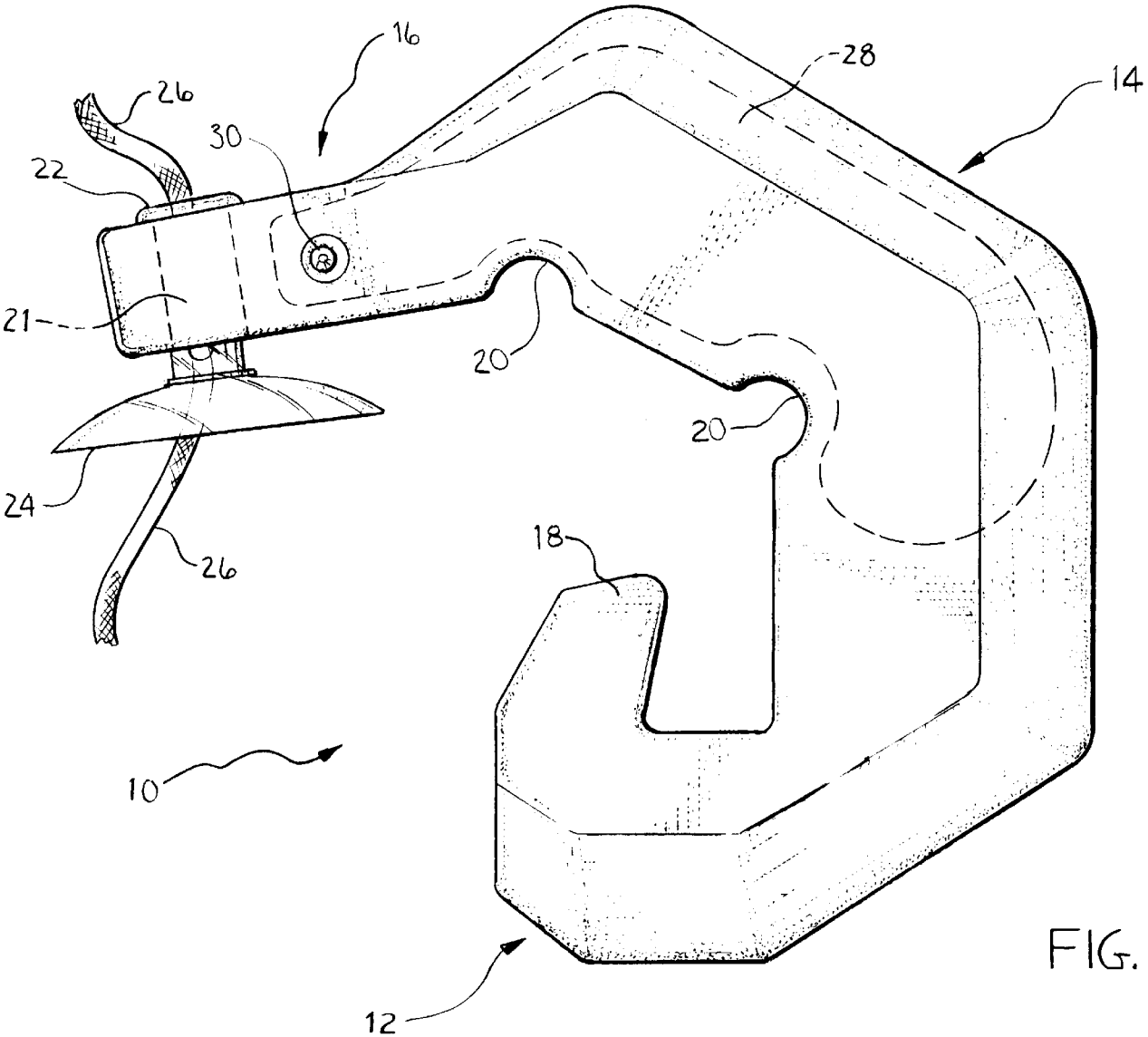
FIG. 2 is a side sectional view of the fender according to the present invention.

The details of the personal watercraft fender according to the invention will be described with reference to FIG. 2. The fender 10 is substantially J-shaped having a curved bottom section 12, an intermediate section 14, and a top section 16. A hook portion 18 forms the curved bottom section 12 and is shaped to hook under the bond flange of the personal watercraft. In preferred embodiments, two notches 20 are formed in the intermediate section 14 and serve as flex regions to enable the fender to flex between the open position and the closed position.

An attachment member channel 21 is formed adjacent an end of the fender opposite from the hook portion 18 in the top section 16. The attachment member channel 21 extends through the top section 16 of the fender and is integrally molded with the fender. The channel 21 is preferably formed with a PVC tube of about ⅛" wall thickness having an inside diameter of about ¾". An attachment member 22 such as a suction cup 24 and/or a securing line 26 can be secured by press fitting in the channel 21. In use, the suction cup serves to fix the fender in place in engagement with the personal watercraft, and the tie line serves to prevent the fender from separating from the personal watercraft.

The fender 10 also includes a gas chamber 28 formed in the intermediate section 14, which is fillable with a pressurized gas such as air. An inflation valve 30 may be provided operatively communicating with the gas chamber 28. The gas chamber and inflation valve provide added cushioning and protection of the personal watercraft fender and also serve to increase the fender useful life.

In the manufacturing process of the personal watercraft fender according to the present invention, the hook portion 18, flex regions 20, and attachment member channel 21 are molded with a suitable material preferably in a rotational molding process. An example of a suitable material is PVC.

In the rotational molding process, plastic resin is loaded in a suitable mold cavity and the mold is clamped shut. The mold is placed into an oven where it is rotated on two axes at low speed (e.g., 5 RPM). The slow rotation creates a tumbling of the material inside the mold. As the mold heats, the resin coats and adheres to the inside mold surface. When the plastic is fully fused, it is cooled by air and/or water spray while it continues to rotate. Rotation is stopped when the mold is cooled to a point where all resin has solidified. The mold can then be opened to remove the finished part.

By virtue of the structure and method according to the present invention, a fender is provided that is particularly suited for a personal watercraft and is readily attachable to a bond flange for quick attachment. The conformable make-up of the fender including at least one flex region enables the fender to conform to the front hull of the personal watercraft or the rear section of the personal watercraft.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fender for a personal watercraft having a bond flange, a front hull, and a rear section, the fender comprising:

a hook portion shaped to hook under the bond flange of the personal watercraft;

at least one flex region spaced from the hook portion, the fender being conformable to either of the front hull and the rear section of the personal watercraft in accordance with the at least one flex region; and an attachment member disposed adjacent an end of the fender opposite from the hook portion, wherein the fender is formed of rotationally molded PVC.

2. A fender according to claim 1, wherein the fender is substantially J-shaped having a curved bottom section, an intermediate section, and a top section, the hook portion forming the curved bottom section, the at least one flex region being disposed in the intermediate section, and the attachment member being disposed in the top section.

3. A fender according to claim 1, further comprising a gas chamber filled with pressurized gas.

4. A fender according to claim 3, wherein the gas is air.

5. A fender according to claim 3, further comprising an inflation valve operatively communicating with the gas chamber.

6. A fender according to claim 1, comprising two flex regions spaced from the hook portion.

7. A fender according to claim 1, wherein the attachment member comprises at least one of a suction cup and a securing line.

8. A fender according to claim 1, wherein the fender is conformable between an open position engageable with the front hull of the personal watercraft and a closed position engageable with the rear section of the personal watercraft.

9. A method of manufacturing a fender for a personal watercraft, the personal watercraft having a bond flange, a front hull, and a rear section, the method comprising:

(a) molding a hook portion shaped to hook under the bond flange of the personal watercraft and at least one flex region spaced from the hook portion such that the fender is conformable to either of the front hull and the rear section of the personal watercraft; and (b) securing an attachment member adjacent an end of the fender opposite from the hook portion.

10. A method according to claim 9, wherein step (a) is practiced by rotational molding.

11. A method according to claim 9, wherein step (a) is practiced by rotational molding PVC.

12. A method according to claim 9, wherein the fender is substantially J-shaped having a curved bottom section, an intermediate section, and a top section, and wherein step (a) comprises molding the hook portion forming the curved bottom section and molding the at least one flex region to be disposed in the intermediate section, and wherein step (b) comprises securing the attachment member in the top section.

13. A method according to claim 9, wherein step (a) further comprises forming a gas chamber filled with pressurized gas.

14. A method according to claim 13, wherein the gas is air.

15. A method according to claim 13, further comprising attaching an inflation valve in operative communication with the gas chamber.

16. A method according to claim 9, wherein step (a) comprises molding two flex regions spaced from the hook portion.

17. A method according to claim 9, wherein step (b) comprises securing at least one of a suction cup and a securing line.

18. A fender for a personal watercraft having a bond flange, a front hull, and a rear section, the fender comprising:

a hook portion shaped to hook under the bond flange of the personal watercraft;

at least one flex region spaced from the hook portion, the fender being conformable to either of the front hull and the rear section of the personal watercraft in accordance with the at least one flex region; and a gas chamber filled with pressurized gas.

19. A fender according to claim 18, wherein the gas is air.

20. A fender according to claim 18, further comprising an inflation valve operatively communicating with the gas chamber.

21. A fender for a personal watercraft having a bond flange, a front hull, and a rear section, the fender comprising:

a hook portion shaped to hook under the bond flange of the personal watercraft, the hook portion including a U-shaped section with opposed inwardly facing sidewalls, the U-shaped section being adapted to receive the bond flange of the personal watercraft;

at least one flex region spaced from the hook portion, the fender being conformable to either of the front hull and the rear section of the personal watercraft in accordance with the at least one flex region; and an attachment member disposed adjacent an end of the fender opposite from the hook portion.

* * * * *